United States Patent [19]

Fast

[11] Patent Number: 4,987,692

[45] Date of Patent: Jan. 29, 1991

[54] MERCHANDISE TAG FOR WIRE ROD OR FLAT CROSSBAR HOOK

[76] Inventor: Jacob Fast, 7561 NW. 9th St., Plantation, Fla. 33317

[21] Appl. No.: 346,697

[22] Filed: May 3, 1989

[51] Int. Cl.[5] ..... A47G 29/10

[52] U.S. Cl. ..... 40/657; 40/124.1; 40/662

[58] Field of Search ..... 40/657, 584, 662, 124.1, 40/124.4

[56] References Cited

U.S. PATENT DOCUMENTS

| | | | |
|---|---|---|---|
| 903,611 | 11/1908 | Smith | 40/662 |
| 1,776,815 | 9/1930 | Lynch | 40/657 |
| 1,802,982 | 4/1931 | Nelson | 40/662 |
| 2,042,672 | 6/1936 | MacLean | 40/124.1 |
| 2,314,721 | 3/1943 | Lowenstein | 40/124.1 |
| 2,525,944 | 7/1985 | Fast . | |
| 3,458,946 | 8/1969 | Lasswell | 40/657 |
| 4,646,454 | 3/1987 | Fast . | |
| 4,665,639 | 5/1987 | Fast . | |
| 4,693,024 | 9/1987 | Fast . | |
| 4,698,929 | 10/1987 | Fast . | |
| 4,703,570 | 11/1987 | Fast . | |
| 4,715,135 | 12/1987 | Fast . | |
| 4,754,563 | 7/1988 | Fast | 40/657 |
| 4,773,172 | 9/1988 | Fast . | |
| 4,882,868 | 11/1989 | Fast | 40/657 |
| 4,888,897 | 12/1989 | Fast | 40/657 |

*Primary Examiner*—Victor N. Sakran

*Attorney, Agent, or Firm*—Fleit, Jacobson, Cohn, Price, Holman & Stern

[57] ABSTRACT

A product information display tag is particularly designed for presenting product information at the forward end of a product support hook of type having a proximal end mounting bracket in the form of a flat plate with prongs for snapping over a wire rod or transverse bar structure. The mounting portion of the tag is in the form of a fold-down panel with a central aperture for receiving the hook so that the panel can be positioned with its rear surface against the front surface of the plate. The panel has fold-back wings with contact adhesive thereon for folding back around the edges of the plate and adhesively securing against the rear surface of the plate. The panel may further have forwardly folding tabs for engaging and stabilizing the intermediate portion of the tag structure.

10 Claims, 1 Drawing Sheet

MERCHANDISE TAG FOR WIRE ROD OR FLAT CROSSBAR HOOK

BACKGROUND OF THE INVENTION

This invention relates to product identification and information tags for merchandise suspended from elongate horizontally orientated support hooks and the like. More particularly, the invention relates to such tags which may be readily attached to and removed from the support hooks without being subject to inadvertent removal, and which display product information forwardly of merchandise supported on a hook.

In recent years, I have designed, for example, a number of elongate product information and identification tags, generally made of plastic sheet, for displaying the product information forwardly of items suspended from horizontal hooks which may extend, for example, from apertured support boards or the like. Examples of such earlier tags may be found, for example, in my prior U.S. Pat. Nos. 4,525,944; 4,646,454; 4,665,639; 4,693,024; 4,698,969; 4,703,570, and 4,715,135.

Generally, tags of the above kind include a mounting portion for attachment to and removal from the hook at a location adjacent the board or the like, an elongate intermediate portion extending forwardly from the mounting portion along the length of the hook and the merchandise suspended therefrom, and a display portion at the distal end of the intermediate portion for the display of product information and the like.

The tags disclosed in the above noted patents are provided with mounting portions suited for different applications to different types of hooks and mountings. Frequently, for example, the support hooks may be adapted to attach to supports other than apertured boards. For example, there are in existence elongate product support hooks having mounting brackets at their proximal ends which are particularly adapted for attachment to a flat transversely extending bar or to transversely extending wire rods. In another one of my prior U.S. Patents, notably U.S. Pat. No. 4,773,172, there is disclosed a product identification tag having a mounting portion particularly suited for use with hooks of this type. It is an object of the present invention to provide a merchandise information and display tag structure of the general type discussed above which has an alternative type of mounting portion particularly adapted to be used with a variety of the flat bar or wire-rod attached hooks.

SUMMARY OF THE INVENTION

Generally stated, the invention provides an elongate product information and display tag of the overall type discussed above, preferably being die-cut or the like from sheet plastic of the kind commonly used for such tags, and including a proximal end mounting portion for attaching the tag to a product support hook, and an elongate intermediate portion extending from the mounting portion to extend over the hook and display product information at the distal end thereof. In particular, in accordance with the invention, the mounting portion may comprise a fold-down panel with contact adhesive provided on the rear surface of the panel extending from the aperture outwardly to cover at least parts of the fold-back wings.

The tag is primarily intended for use on product support hooks of the type which have a substantially flat mounting bracket with upper and lower prongs which snap over a flat transverse support bar or spaced transverse wire-rods. In use, to mount the tag on such a hook the aperture in the mounting portion is fitted over the front of the hook and moved back towards the bracket so that the mounting panel lies face to face with the front of the bracket. The panel has a width such that the lateral wings extend beyond the side edges of the hook bracket and can be folded back behind the bracket where they may be adhered to the surface of the bracket by means of the contact adhesive. Thus, a simple and secure mounting of the tag on the hook bracket is provided.

In a preferred form of the invention, the fold-down mounting panel may, at its upper margin, also include forwardly folding upper flanges or tabs which form stabilizers against which the proximal end of the intermediate portion of the tag may engage.

Additional features and advantages of the invention will be apparent from ensuing description and claims read in conjunction with the attached drawings.

DESCRIPTION OF PREFERRED EMBODIMENTS

Figure 1:
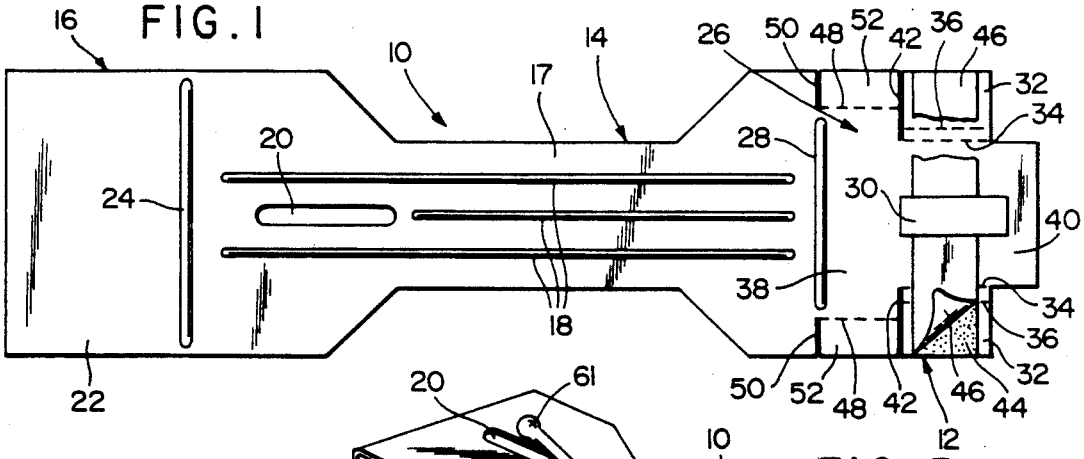
FIG. 1 is a plan view of a product identification and information tag in accordance with the invention prior to folding the tag into its functional state.

Referring initially to FIG. 1, there is shown therein a product information and display tag 10 of plastic sheet which is generally of the kind referred to in the above noted patents and which includes a mounting portion 12 for attaching the tag at the proximal end of a product support hook, as will be described, an elongate intermediate portion 14 for extending over the hook and products supported there on, and a distal end display portion 16 for displaying product information forwardly of the hook.

In the embodiment illustrated, the intermediate portion 14 has a reduced width central section 17, longitudinal reinforcing ribbing 18 and an elongate slot 20 adjacent the distal end thereof for a hook to extend through in known manner. The display portion 16 comprises a fold-down panel 22 separated from the intermediate portion by a transverse fold line 24.

It is to be understood that the particular form of the intermediate portion 14 and the display portion 16 above described are given by way of example only and such portions of the tag may take any of the alternatives configurations shown and disclosed in the above noted patents, the disclosures of which are all incorporated herein by reference. For example, the display portion can be a separate attachable/detachable element.

The present invention is primarily concerned with the structure of the mounting portion 12 which generally stated is in the form of a fold-down panel 26 separated from the intermediate portion 14 by a further transverse fold line 28. Panel 26 has a substantially centrally disposed elongate rectangular aperture 30 and a pair of lateral fold back tabs or wings 32 on opposite sides of the aperture. The wings 32 are defined by inner longitudinal fold lines 34. An outer longitudinal fold line 36 is spaced from the fold line 34 approximately by the thickness of a hook bracket (to be described) to which the tag to be attach. It will be evident that the forward portion 38 of panel 26 is wider than rearward portion 40 and the wings 36 are further defined by transverse cuts 42 between said portions.

On the top surface of the tag as shown in FIG. 1, areas of contact adhesive 44 are provided to extend on each side from aperture 30 to the end of the respective wing 32, such areas being covered prior to use by release papers 46.

The mounting panel 26 further includes outer longitudinal fold lines 48 and transverse cuts 50 which define forward folding-tabs or flanges 52 adjacent portion 38 of the panel, the purpose of which will be evident hereinafter.

Figure 2:
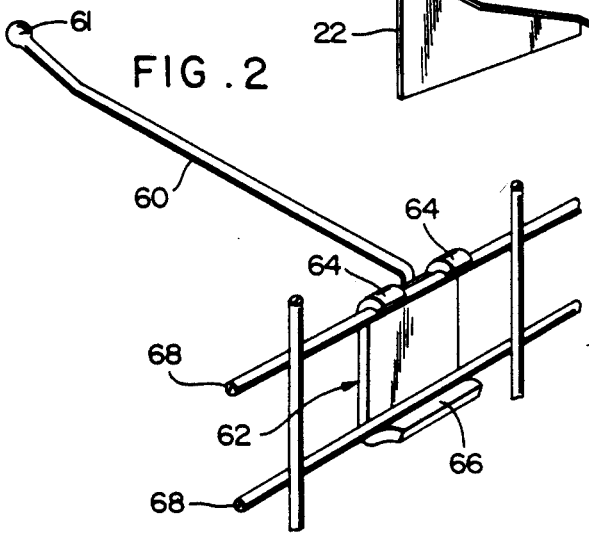
FIG. 2 a perspective view of a hook with which the tag is intended for use, the hook being shown mounted on a wire-rod structure.
Figure 3:
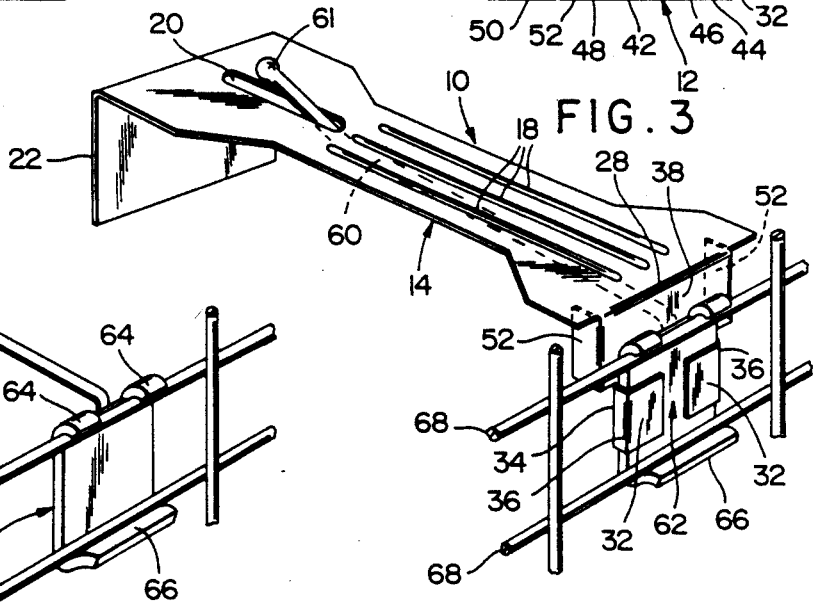
FIG. 3 is a view similar to FIG. 2 showing the tag in its functional state mounted on the hook.
Figure 4:
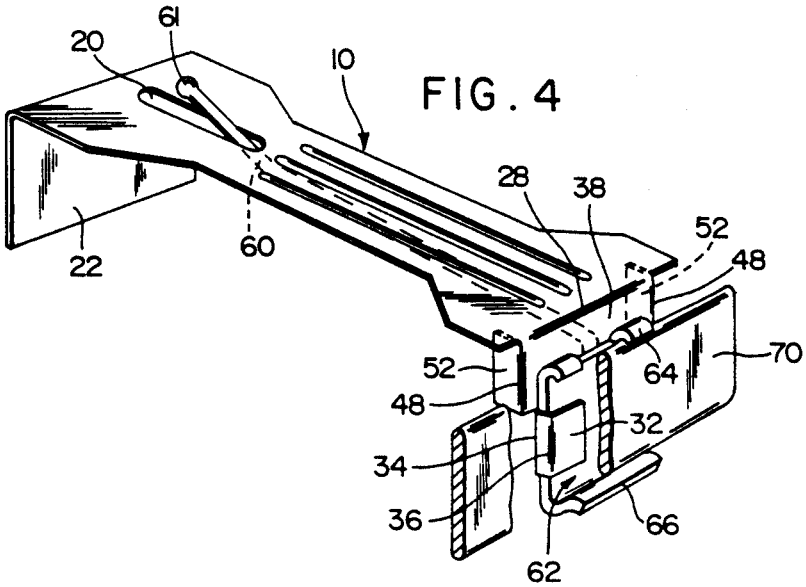
FIG. 4 is a view similar to FIG. 3 showing the hook mounted on a flat transverse bar.

The above described tag structure 10 is primarily intended for use with a hook structure as shown in FIGS. 2 through 4. Such structure comprises an elongate rod type hook 60 secured to a proximal end mounting bracket 62. Bracket 62 comprises a generally flat rectangular plate with respective upper and lower prongs 64, 66 which may alternatively snap over spaced transverse wire rods 68 as shown FIGS. 2 and 3 or over a flat transverse support bar 68 as shown in FIG. 4. This type of hook and mounting bracket 17 are known per se.

In order to attach the tag 10 to the hook structure shown in FIGS. 2 through 4, the mounting panel 26 is folded down, substantially at right angles, about fold line 28 and the tabs or flanges 52 are folded forwardly about fold line 48, as shown FIGS. 3 and 4, to provide stabilizing abutments for the proximal end of the intermediate portion 14. Then, aperture 30 is inserted over the proximal end 61 of the hook and the tag is moved back until panel 26 engages the front surface of bracket 62. As seen in FIGS. 3 and 4 the width of portion 40 of panel 26 conforms substantially to the width of brackets 62. The release papers 46 having being removed from the adhesive areas 44, the wings 32 are then folded back and around the rear surface of bracket 62 and they are pressed into engagement with the rear surface in order to firmly secure the tag through the adhesive 44. It is understood that folding of the wings around the back of bracket 62 is facilitated by the provision of the spaced fold lines 34, 36.

It will be evident that in the case of the wire rod structures 68 shown in FIGS. 2 and 3, the tag 10 can be secured to the hook after the hook bracket has been secured to the wire rods, but in the case of the transverse bar structure 70 shown in FIG. 4, the tag 10 should be secured to the hook prior to its attachment to the bar.

It will be further evident that the invention provides a simple yet unique means for attaching an elongate product information and display tag to a hook bracket of the type described. While only preferred embodiments of the invention have been described herein in detail, the invention is not limited thereby and modifications can be made within the scope of the attached claims.

What I claim is:

1. A product information display tag for presenting product information at a distal end of an elongate product support hook, the tag comprising an elongate strip of sheet material having a proximal end mounting portion for securing same at a proximal end of a hook, and an elongate intermediate portion extending from the mounting portion to extend over the hook and provide product information at a distal end thereof, wherein the mounting portion comprises a fold-down panel having a substantially centrally located aperture, laterally extending fold-back wings extending from opposite sides of said panel, and areas of contact adhesive at least on surfaces of the wings adapted to face inwardly when the wings are folded back.

2. The invention as defined in claim 1 wherein the areas of adhesive extend over portions of the panel between the respective wings and said aperture.

3. A product information display tag for presenting product information at a distal end of an elongate product support hook, the tag comprising an elongate strip of sheet material having a proximal end mounting portion for securing same at a proximal end of a hook, and an elongate intermediate portion extending from the mounting portion to extend over the hook and provide product information at a distal end thereof, wherein the mounting portion comprises a fold-down panel having a substantially centrally located aperture, laterally extending fold-back wings extending from opposite sides of said panel, and areas of contact adhesive at least on surfaces of the wings wherein each wing is separated from the panel by a first longitudinal fold line, and wherein each wing includes a second longitudinal fold line adjacent the first fold line.

4. A product information display tag for presenting product information at a distal end of an elongate product support hook, the tag comprising an elongate strip of sheet material having a proximal end mounting portion for securing same at a proximal end of a hook, and an elongate intermediate portion extending from the mounting portion to extend over the hook and provide product information at a distal end thereof, wherein the mounting portion comprises a fold-down panel having a substantially centrally located aperture, laterally extending fold-back wings extending from opposite sides of said panel, and areas of contact adhesive at least on surfaces of the wings wherein the panel is separated from the intermediate portion of the tab by a transverse fold line, and wherein the panel includes outer fold-forward tabs defined by respective lengthwise fold lines, the tabs being located between the wings and the transverse fold line, and having upper margins defined by transverse cuts on opposite sides of the transverse fold line.

5. The invention as defined in claim 4 wherein the panel has a narrower portion from which the wings extend and a wider portion from which the tabs extend.

6. A combination comprising an elongate product support hook having a proximal end mounting bracket in the form of a substantially flat plate with upper and lower prongs for mounting same on a transverse bar or wire rod structure, and an elongate product information display tag for presenting product information at a distal end of the hook, the tag comprising an elongate strip of sheet material having a proximal end mounting portion for securing the strip to said bracket an elongate intermediated portion for extending over the hook, wherein the mounting portion comprises a fold-down panel with an aperture for receiving the hook so that a rear surface of said panel can be positioned substantially against the front surface of said plate, the panel further having laterally extending fold-back wings on opposite sides thereof with adhesive inner surfaces for folding back around opposite sides of said plate and adhesive securement against a back surface of the plate.

7. The invention as defined in claim 6 wherein portions of the panel adjacent the wings have an adhesive surface for securement to the front surface of the plate.

8. A combination comprising an elongate product support hook having a proximal end mounting bracket in the form of a substantially flat plate with upper and lower prongs for mounting same on a transverse bar or wire rod structure, and an elongate product information display tag for presenting product information at a distal end of the hook, the tag comprising an elongate strip of sheet material having a proximal end mounting portion for securing the strip to said bracket an elongate intermediated portion for extending over the hook, wherein the mounting portion comprises a fold-down panel with an aperture for receiving the hook so that a rear surface of said panel can be positioned substantially against the front surface of said plate, the panel further having laterally extending fold-back wings on opposite sides thereof with adhesive back surfaces for folding back around opposite sides of said plate and adhesive securement against a back surface of the plate wherein the mounting panel has forward-folding tabs on opposite sides thereof for engaging proximal end portions of the intermediate portion of the tag and stabilizing same.

9. The invention as defined in claim 8 wherein the panel as a wider portion between the tabs and a narrower portion between the wings.

10. A combination comprising an elongate product support hook having a proximal end mounting bracket in the form of a substantially flat plate with upper and lower prongs for mounting same on a transverse bar or wire rod structure, and an elongate product information display tag for presenting product information at a distal end of the hook, the tag comprising an elongate strip of sheet material having a proximal end mounting portion for securing the strip to said bracket an elongate intermediated portion for extending over the hook, wherein the mounting portion comprises a fold-down panel with an aperture for receiving the hook so that a rear surface of said panel can be positioned substantially against the front surface of said plate, the panel further having laterally extending fold-back wings on opposite sides thereof with adhesive back surfaces for folding back around opposite sides of said plate and adhesive securement against a back surface of the plate wherein each wing is separated from the panel by a first longitudinal fold line and wherein each wing includes a second longitudinal fold line and wherein each wing includes a second longitudinal fold line spaced from the first longitudinal fold line substantially by the thickness of said plate.

* * * * *